US005275304A

United States Patent [19]

Abrams

[11] Patent Number: 5,275,304

[45] Date of Patent: Jan. 4, 1994

[54] PARTITIONED CONTAINER

[76] Inventor: Matthew L. Abrams, 3525 Fox Chase Dr., Imperial, Pa. 15126

[21] Appl. No.: 982,905

[22] Filed: Nov. 30, 1992

[51] Int. Cl.[5] ..... B65D 5/00

[52] U.S. Cl. ..... 220/525; 220/253; 220/710

[58] Field of Search ..... 220/525, 253, 710

[56] References Cited

U.S. PATENT DOCUMENTS

| | | | |
|---|---|---|---|
| 2,262,897 | 11/1941 | Lewis | 220/253 |
| 2,731,013 | 1/1956 | Holmes | 220/525 |
| 3,486,665 | 12/1969 | Croce | 220/253 |
| 4,541,541 | 9/1985 | Hickman et al. | 220/253 |
| 4,991,737 | 2/1991 | Edelman | 220/525 |

*Primary Examiner*—Joseph Man-Fu Moy
*Attorney, Agent, or Firm*—E. M. Combs

[57] ABSTRACT

A partitioned container includes a container cavity partitioned into a plurality of container cavities by means of intersecting partition walls within the container. A container first lid is rotatably mounted relative to a container underlying second lid, with the first lid having a first lid aperture selectively aligned with one of a plurality of second lid apertures, with one of the second lid apertures aligned and positioned above each of the partition cavities within the container. A tubular drinking tube member is arranged for selective mounting to a side wall of the container.

4 Claims, 4 Drawing Sheets

PARTITIONED CONTAINER

BACKGROUND OF THE INVENTION

1. Field of the Invention

The field of invention relates to container structure and more particularly pertains to a new and improved partitioned container wherein the same is arranged for the selective consumption of fluids from one of a plurality of cavities within an associated container structure.

2. Description of the Prior Art

Containers of various types have been utilized throughout the prior art for the dispensing and storage of various consumable components. Prior art container structure is indicated in the U.S. Pat. Nos. 3,743,520; 4,928,876; 4,826,034; 4,923,083; and 5,048,709 to Alverson indicating the deployment of a mounting of a drinking tube adjacent to a container structure.

As such, it may be appreciated there continues to be a need for a new and improved partitioned container as set forth by the instant invention which addresses both the problems of ease of use as well as effectiveness in construction in a manner not addressed by the prior art by providing for a readily accessed plurality of container cavities accessed by means of a drinking tube and in this respect, the present invention substantially fulfills this need.

SUMMARY OF THE INVENTION

In view of the foregoing disadvantages inherent in the known types of container structure now present in the prior art, the present invention provides a partitioned container wherein the same provides for a plurality of container cavities accessed through a rotatable top lid relative to an underlying lid in the container structure. As such, the general purpose of the present invention, which will be described subsequently in greater detail, is to provide a new and improved partitioned container which has all the advantages of the prior art container structure and none of the disadvantages.

To attain this, the present invention provides a partitioned container including a container cavity partitioned into a plurality of container cavities by means of intersecting partition walls within the container. A container first lid is rotatably mounted relative to a container underlying second lid, with the first lid having a first lid aperture selectively aligned with one of a plurality of second lid apertures, with one of the second lid apertures aligned and positioned above each of the partition cavities within the container. A tubular drinking tube member is arranged for selective mounting to a side wall of the container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved partitioned container which has all the advantages of the prior art container structure and none of the disadvantages.

It is another object of the present invention to provide a new and improved partitioned container which may be easily and efficiently manufactured and marketed.

It is a further object of the present invention to provide a new and improved partitioned container which is of a durable and reliable construction.

An even further object of the present invention is to provide a new and improved partitioned container which is susceptible of a low cost of manufacture with regard to both materials and labor, and which accordingly is then susceptible of low prices of sale to the consuming public, thereby making such partitioned containers economically available to the buying public.

Still yet another object of the present invention is to provide a new and improved partitioned container which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
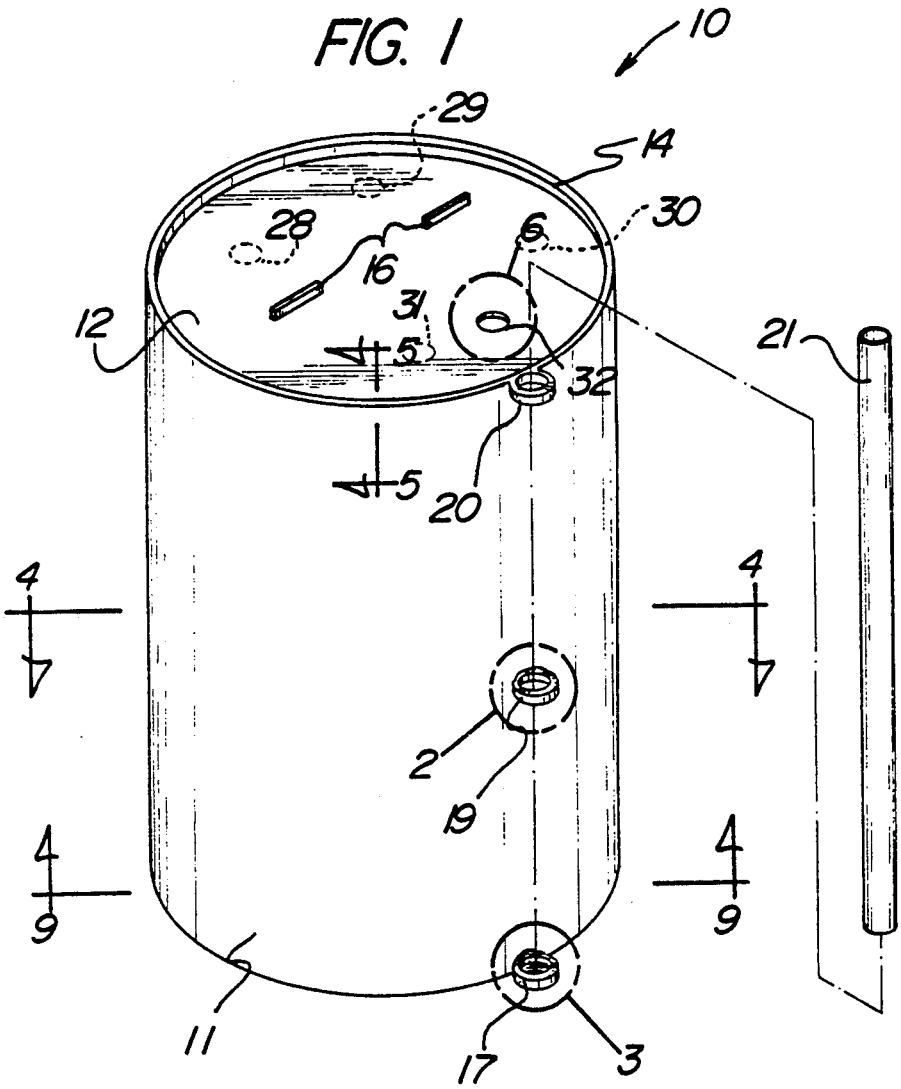
FIG. 1 is an isometric illustration of the invention.
Figure 2:
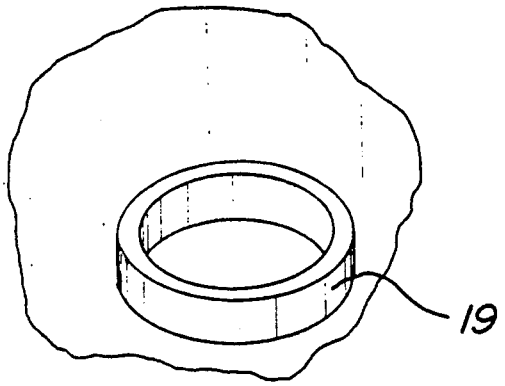
FIG. 2 is an isometric illustration of section 2 as set forth in FIG. 1.
Figure 3:
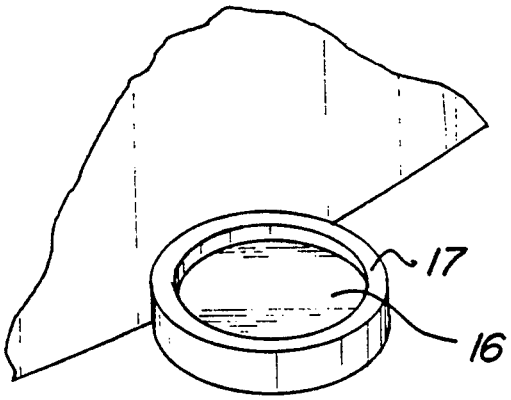
FIG. 3 is an isometric illustration of section 3 as set forth in FIG. 1.

With reference now to the drawings, and in particular to FIGS. 1 to 10 thereof, a new and improved partitioned container embodying the principles and concepts of the present invention and generally designated by the reference numeral 10 will be described.

More specifically, the partitioned container 10 of the instant invention essentially comprises a container cylindrical wall 11 having an annular first side wall flange projecting above a rotary first top wall 12 relative to a fixed second top wall 13, wherein the first top wall 12 is rotatably mounted within an annular groove 15 in adjacency to the second top wall 13. A base spring 17 is fixedly mounted to the side wall 11 spaced below and coaxially aligned relative to an intermediate ring 19 that is coaxially aligned relative to a top ring 20. The base ring 17 has a base ring floor 18, wherein a drinking tube 21 is directed through the rings 20 and 19 and positioned within the base ring 17 onto the floor 18 in a frictionally contained control of the drinking tube 21 relative to the supporting ring structure.

Figure 4:
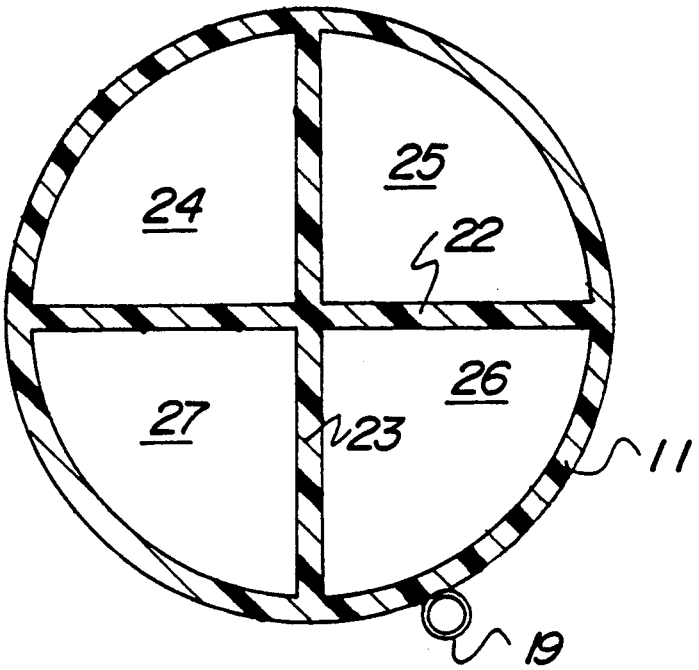
FIG. 4 is an orthographic view, taken along the lines 4—4 of FIG. 1 in the direction indicated by the arrows.
Figure 5:
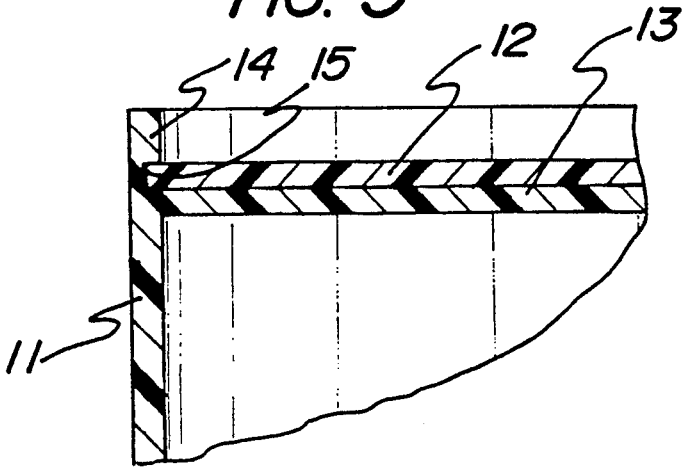
FIG. 5 is an orthographic view of the top wall relative to the bottom wall within the container structure.
Figure 6:
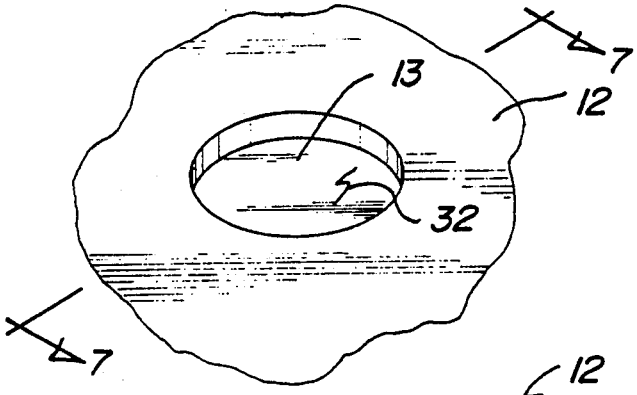
FIG. 6 is an isometric illustration of section 6 as set forth in FIG. 1.
Figure 7:
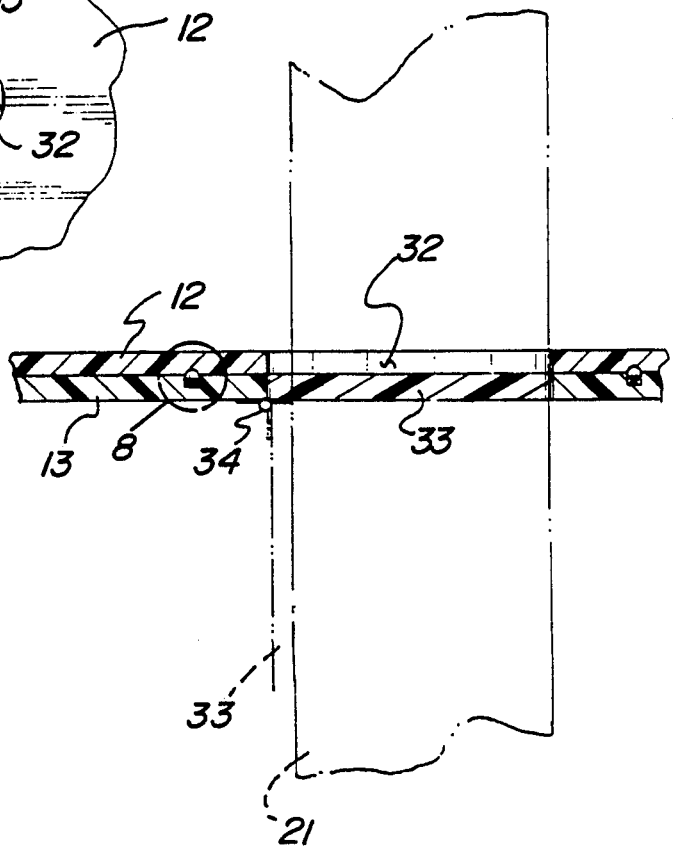
FIG. 7 is an orthographic view, taken along the lines 7—7 of FIG. 6 in the direction indicated by the arrows.
Figure 8:
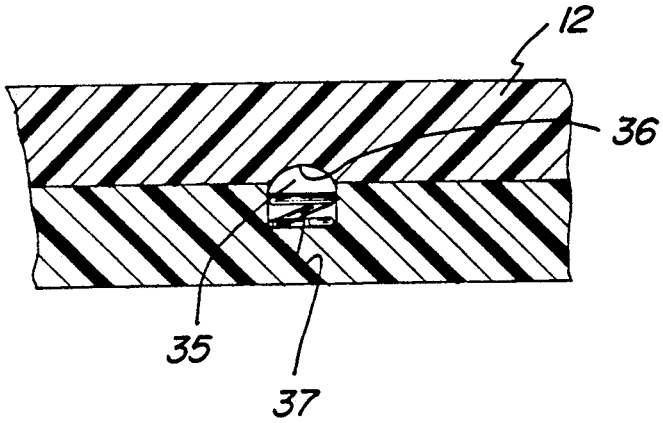
FIG. 8 is an enlarged orthographic view of section 8 as set forth in FIG. 7.

The container of the invention includes a container bottom wall 38, with respective first and second partition walls 22 and 23 orthogonally intersecting one another and coextensive between the container second top wall 13 and the container bottom wall 38 defining respective first, second, third, and fourth cavities 24, 25, 26, and 27, as indicated in FIG. 4. A respective first, second, third, and fourth second top wall apertures 28, 29, 30, and 31 respectively is directed through the second top wall positioned over a respective first through fourth cavity 24–27. The first top wall includes a first top wall aperture 32 that is selectively oriented in alignment with one of the first through fourth second top wall apertures 28–31. In this manner, the drinking tube 21 is directed through the first top wall aperture 32 and one of the second top wall apertures 28–31. A door plate 33 is pivoted about a spring hinge 34 mounted within each of the second top wall apertures 28–31, whereupon projection of the drinking tube 21 through the first top wall aperture effects displacement of the door plate 33 for access into one of the first through fourth cavities 24–27. To further assist in alignment of the first top wall relative to the second top wall for alignment of the first top wall aperture 32 relative to one of the second top wall apertures 28–31, an annular array of abutment semi-spherical plugs 35 biased by means of a spring 37 is projected from the second top wall into engagement with one of an annular array of semi-spherical recesses 36 directed into a bottom surface of the first top wall 12. In this manner, when the semi-spherical plugs 35 is received within the semi-spherical recess 36, the first top wall aperture 32 is aligned with one of the second top wall apertures 28–31. It should be noted that the semi-spherical plugs 35 and the semi-spherical recesses 36 are aligned relative to the alignment of the top wall aperture and the second top wall apertures to provide for the coaxially aligned registration, as indicated in FIG. 7.

Figure 9:
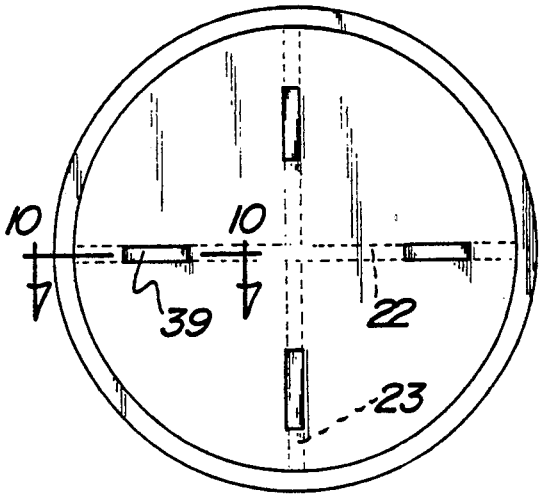
FIG. 9 is an orthographic view, taken along the lines 9—9 of FIG. 1 in the direction indicated by the arrows.
Figure 10:
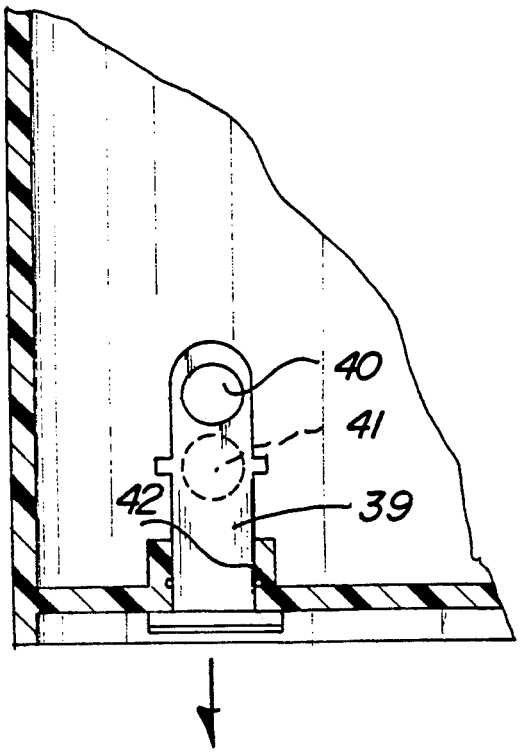
FIG. 10 is an orthographic view, taken along the lines 10—10 of FIG. 9 in the direction indicated by the arrows.

Further, as indicated in FIGS. 9 and 10, the bottom wall 39 includes a plurality of mixing plates 39, with a mixing plate 39 directed through each partition wall at an inner face between adjacent cavities, as indicated in FIG. 9. The mixing plate 39 includes a mixing plate bore 40 that is selectively aligned with a partition wall 41 within each of the partition walls in an inner face between adjacent cavities. In this manner, the mixing plate 39 is reciprocatably mounted within a bottom wall bore 42 in a sealed relationship to provide for selective alignment of the mixing plate bore 40 with a partition wall bore 41 to provide for selective mixing of fluids from adjacent cavities for enhanced enjoyment in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A partitioned container, comprising, a cylindrical side wall, and a bottom wall, and a first top wall rotatably mounted within the cylindrical side wall, and a second top wall in adjacency to the first top wall for ease of rotation of the first top wall and grasping of the handle means for rotation of the first top wall relative to the second top wall, and the second top wall includes a plurality of second top wall apertures, and the first top wall includes a first top wall aperture, within the first top wall aperture is rotatably aligned with one of the second top wall apertures, and at least one partition wall arranged coextensively between the second top wall and the bottom wall positioned between the second top wall apertures, and a base ring, the base ring positioned in adjacency relative to the bottom wall, with the base ring having a base ring floor, and an intermediate ring positioned fixedly to the side wall coaxially aligned with the base ring, and a top ring mounted in adjacency to the first top wall coaxially aligned with the intermediate ring and the base ring, and a drinking tube slidably received within the top ring, the intermediate ring, and the base ring for mounting upon the base ring floor.

2. A container as set forth in claim 1 wherein each of the second top wall apertures includes a door plate, and each door plate includes a spring hinge hingedly mounting the door plate.

3. A container as set forth in claim 2 wherein the second top wall includes at least one semi-spherical plug and a spring biasing the semi-spherical plug to the first top wall, and the first top wall having at least one semi-spherical recess for receiving the semi-spherical plug therewithin, wherein the at least one semi-spherical recess and the one semi-spherical plug are positioned in coaxially aligned engagement relative to one another when the first top wall aperture is received within one of the second top wall apertures.

4. A container as set forth in claim 3 wherein the at least one partition wall includes at least one partition wall bore, and the bottom wall includes a mixing plate reciprocatably mounted through the bottom wall within a bottom wall bore, and the mixing plate having a mixing plate bore, wherein the mixing plate bore is selectively aligned with the partition wall bore when the mixing plate is reciprocated within the bottom wall bore.

* * * * *